US005577624A

United States Patent [19]

Berta et al.

[11] Patent Number: 5,577,624

[45] Date of Patent: Nov. 26, 1996

[54] CHILD RESISTANT EASY OPEN CLOSURE MECHANISM

[75] Inventors: Norbert I. Berta, Devon; Harry S. Sowden, Southampton, both of Pa.

[73] Assignee: McNeil-PPC, Inc., Skillman, N.J.

[21] Appl. No.: 399,394

[22] Filed: Jun. 3, 1995

[51] Int. Cl.[6] ..... B65D 50/10

[52] U.S. Cl. ..... 215/221; 215/223; 215/44

[58] Field of Search ..... 215/204, 206, 215/216–225, 274, 44, 46

[56] References Cited

U.S. PATENT DOCUMENTS

| | | | |
|---|---|---|---|
| 3,695,475 | 10/1972 | Ruckberg | 215/217 |
| 3,860,152 | 1/1975 | Marti | 215/224 X |
| 3,901,400 | 8/1975 | Westfall | 215/225 X |
| 3,923,181 | 12/1975 | Libit | 215/224 |
| 4,512,485 | 4/1985 | Agbay et al. | 215/225 |
| 4,579,239 | 4/1986 | Hart | 215/216 X |
| 4,948,002 | 8/1990 | Thorneck et al. . | |
| 5,230,433 | 7/1993 | Hamilton et al. | 215/221 |
| 5,397,008 | 3/1995 | Glynn | 215/225 |
| 5,411,157 | 5/1995 | King et al. | 215/216 X |

FOREIGN PATENT DOCUMENTS

| | | | |
|---|---|---|---|
| 2294935 | 7/1976 | France | 215/224 |
| 2028780 | 3/1980 | United Kingdom | 215/206 |

*Primary Examiner*—Allan N. Shoap
*Assistant Examiner*—Nathan Newhouse
*Attorney, Agent, or Firm*—Paul A. Coletti

[57] ABSTRACT

A child resistant container which describes: (1) a bottle having a neck, the bottle also having a containment area to store tablets accessible through an opening in the neck; (2) a cap having a skirt, the skirt engageable with the neck; and (3) an access device for allowing attachment of the neck with the skirt of the cap, including: (i) a push button associated with the cap; (ii) an irregularity contained on the inside of the cap; and (iii) an alignment device on the neck, engaged with the irregularity on the cap. When the push button is pushed by the user, the irregularity enters the alignment device such that the cap may be translated parallel to the longitudinal axis of the bottle. The skirt and neck respectively engage one another, so that thereafter the cap may be removed from the bottle.

10 Claims, 8 Drawing Sheets

CHILD RESISTANT EASY OPEN CLOSURE MECHANISM

FIELD OF THE INVENTION

Generally this invention relates to a easy to open container for holding analgesics. More specifically, this invention relates to a child resistant easy to open container for dispensing analgesics.

BACKGROUND OF THE INVENTION

Easy to open containers for dispensing analgesics have met with much market approval. These containers in various forms describe a generally cylindrically shaped skirt attached to a flange. The flange may be gripped by the user and rotated about the container. With the easy to open bottle there generally needs to be a rotation of one-quarter turn in order to fully disengage the threads contained on the cap from the threads contained on the neck of the bottle.

With the advent of the use of such containers, a drawback becomes apparent. That is, because the containers are easy to open, they are similarly easy to open for young children. In this light, the manufacturers of such bottles must place appropriate warnings on the bottles indicating that such containers are not to be used in homes where young children are present.

SUMMARY OF THE INVENTION

With the growth of this industry, therefore there is now a need for a child resistant, easy to open container. While such a definition may seem to be a oxymoron, in fact the term is well accepted in the field. That is, child resistancy is defined by the inability a young child, after witnessing opening of the bottle, to replicate the opening in a prescribed amount of time and steps. It is not defined as the total inability of the child to open the bottle. As such, typically, child resistancy will ensue where there is at least a substantial difficulty in performing a step or set of steps in order to properly open the container.

A child resistant easy to open bottle is described by this invention. The container comprises a bottle which has a threaded neck and is defined by a cylinder contained around a longitudinal axis. The bottle has a containment area which is able to store tablets. The containment area is accessible through an opening in the neck. The bottle contains a cap having a threaded skirt. The threads on the skirt are engageable with the threads on the neck. Typically, the cap be rotated 90° after engagement of the threads on the cap with the threads on the neck so that the cap is removable from the bottle. Furthermore, there are access means contained in the invention which allow attachment of the threads on the neck with the threads on the skirt. The access means generally comprise a push button associated with the cap, and an irregularity contained on the inside of the cap, and alignment means on the neck, where the alignment means are engageable with the irregularity on the cap. Alternately, of course, the design can be made with a non-threaded cap, so that the cap can merely be "flipped" off the neck of the container.

In use of this invention, when the push button is pushed by the user, the regularity enters the alignment means. Thereafter, the cap may be translated parallel to the longitudinal axis of the bottle, so that the respective thread means on the neck and cap engage one another. Thereafter, the cap may be unscrewed from the bottle, generally in a quarter turn, thereby classifying the device as both child resistant and easy to open.

DESCRIPTION OF THE DRAWINGS

This invention will be better understood from the attached drawings, wherein.

DETAILED DESCRIPTION OF THE INVENTION

Figure 1:
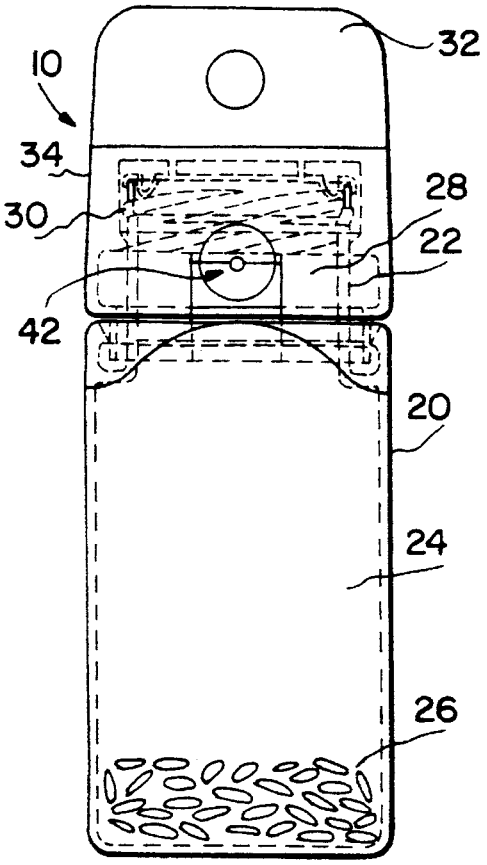
FIG. 1 is a cross sectional view of an embodiment of this invention.
Figure 2:
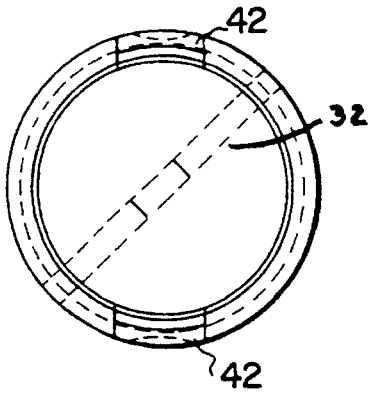
FIG. 2 is a top cross sectional view of the engagement between the cap and the bottle of FIG. 1.
Figure 3:
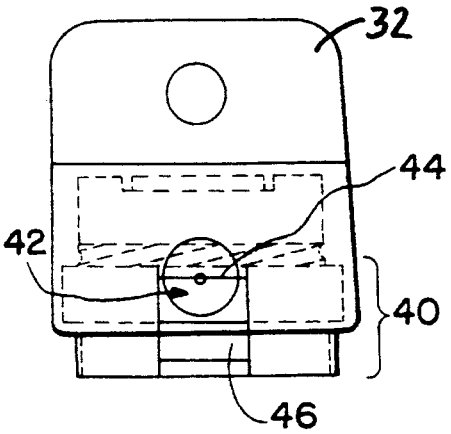
FIGS. 3 and 4 are enlarged views of the engagement between the bottle and the cap.
Figure 4:
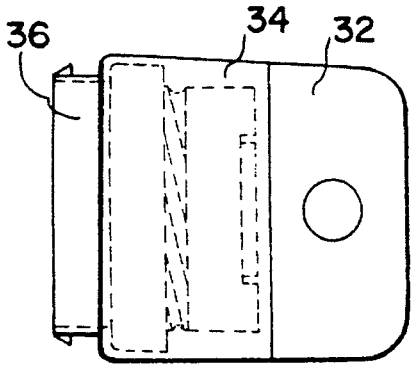

The invention will now be better understood by referring to the drawings already described. Referring to FIGS. 1 through 4, there is disclosed a child resistant container 10 which is described by a bottle 20 containing a threaded neck 22. The bottle 20 has a containment area 24 which is able to store tablets 26. The containment area 24 is accessible through the opening 28 contained in the neck 22. The number of threads 30 on the neck 20 are generally between four to eight, and is operable so that the cap 32 (which will be further described) can be removed with about a quarter turn revolution. Such an easy to open mechanism is generally described in King et al., U.S. Pat. No. 5,213,225 incorporated herein by reference.

The cap 32 itself contains a skirt 34 which is similarly threaded on its internal section 36. The cap 32 fits on the bottle neck 20. The threads 38 on the skirt 34 are engageable with the threads 30 on the neck of the bottle 20.

The invention described herein comprises access means 40 which allow attachment of the threads 30 on the neck 22 with the threads 38 on the skirt 34. These access means 40 are generally described in FIGS. 1 through 4 as a push button 42, an irregularity or circular depression 44 located on the inside surface 26 of the skirt 34, and alignment means or a groove 46 placed on the neck 20 of the bottle 12. These will be further described herein.

The embodiment described by FIGS. 1 to 4 shows push buttons 42 generally placed on diametrically opposed sides of the cap 32. The push buttons 42 are intended to be squeezed by the user so that the cap 32 may be deformed from a generally cylindrical shape to a generally ovoid shape when viewed in cross section. Upon the pushing of the cap 32 by the push buttons toward one another, designated as step "A" in FIG. 17, the irregularity 44 contained on the inside of the skirt 34 is able to be moved from one position out of engagement with the groove 46 on the neck 20 to a second position wherein the ball 44 may be engaged with the groove 46 on the neck 20. Of course, is will be readily appreciated that it is only upon movement of the push button mechanism 42 into such a deformed position that there is alignment between the ball 44 and the groove 46. In a nondeformed position, the cap 32 containing the push button 42 mechanism is able to rotate freely around the longitudinal axis of the neck 22 of the bottle 20.

Figure 17:
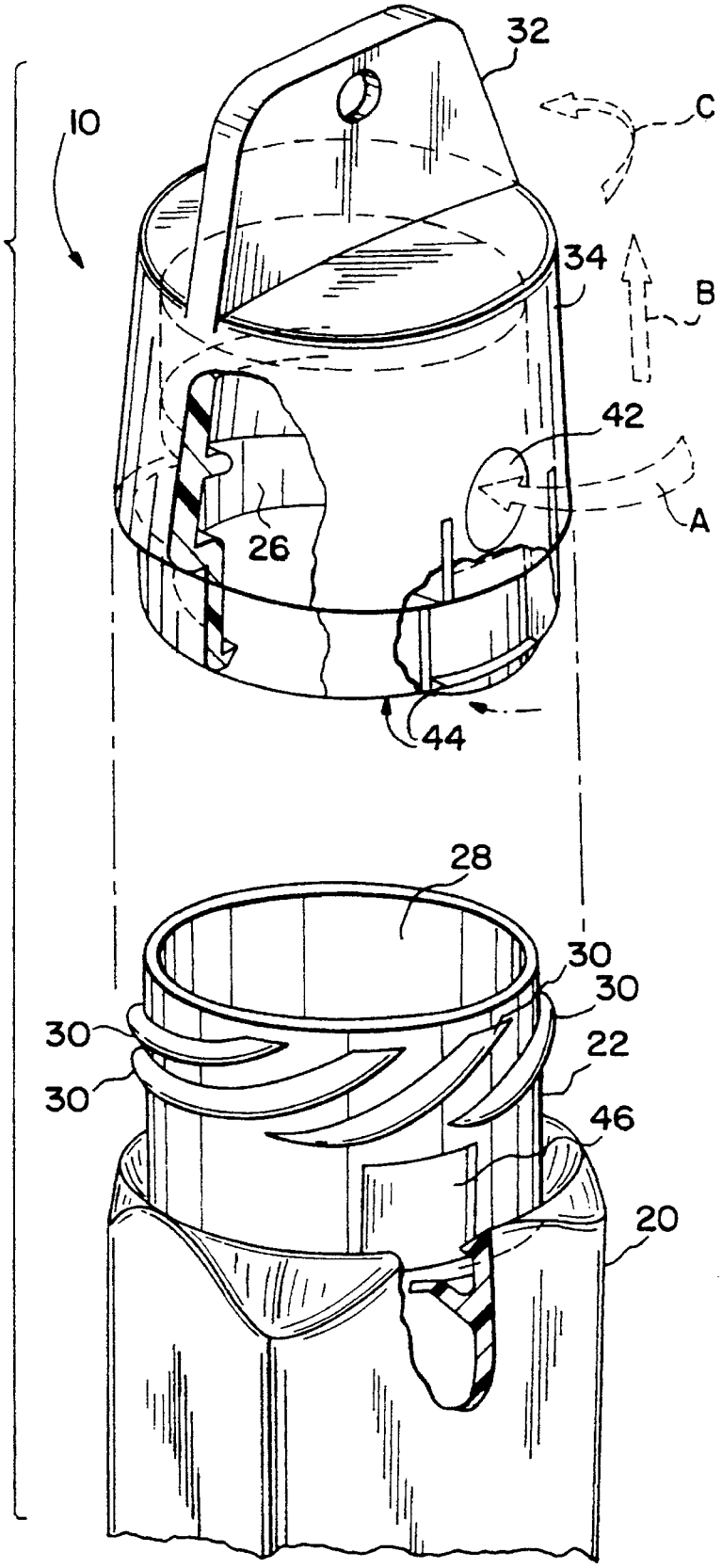
FIG. 17 is a perspective view of the cap of FIGS. 1–4 in use.

When the push buttons are depressed so that the cap 32 is deformed, the ball 44 contained on the cap 32 is able to be aligned with the groove 46 contained on the neck 22. Thereafter, the user is able to lift or pry the cap 32 away from the bottle 20 so that the ball 44 moves away from the bottle 20 within the groove 44 of the neck 22, designated at step "B" in FIG. 17. Upon reaching the top of the groove 22, the threads 38 of the cap 32 engage the threads 30 on the neck 22 of the bottle. Thereafter, operation of the cap 32, designated as step "C" in FIG. 17, is similar to operation of the threads described in the previously cited King '225 patent, incorporated by reference.

Figure 5:
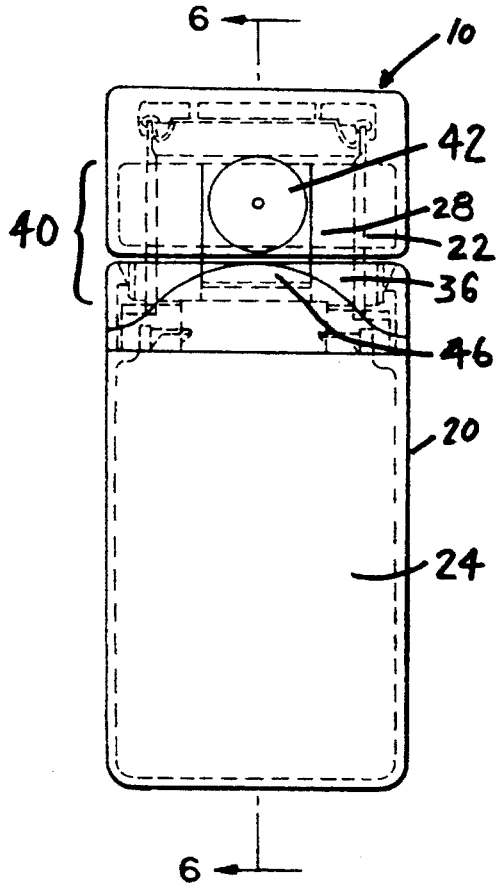
FIGS. 5 and 6 are alternative designs of the engagement between the alignment means and the irregularity on the cap of FIG. 1.
Figure 6:
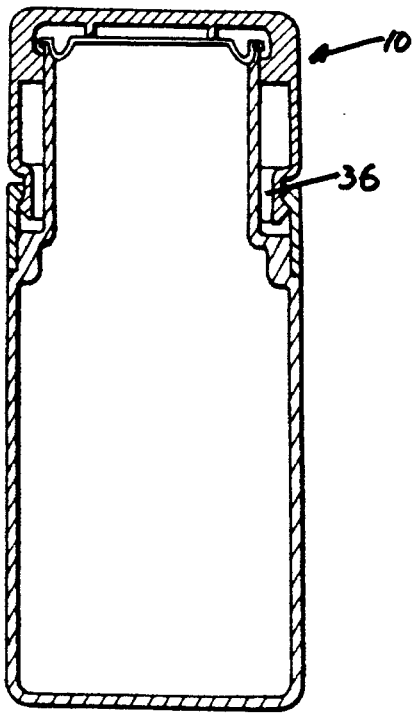
Figure 9:
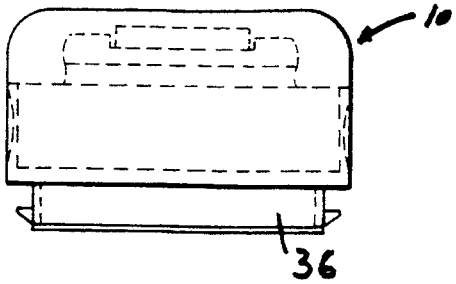
FIGS. 7, 8 and 9 are other alternate designs of the embodiment of FIG. 1.
Figure 7:
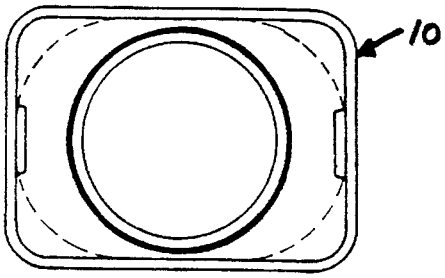
Figure 8:
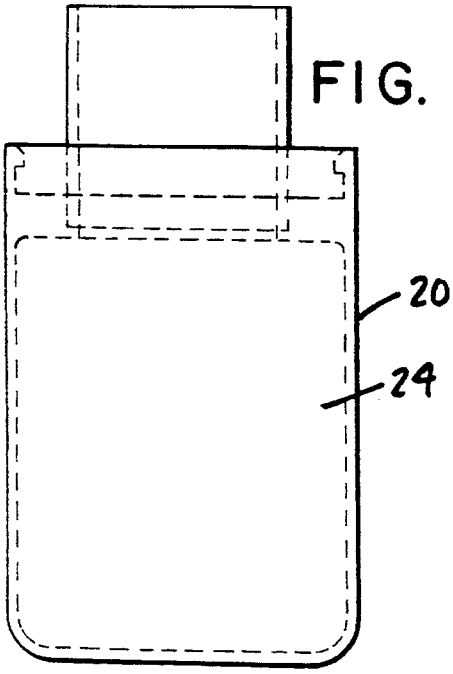
Figure 10:
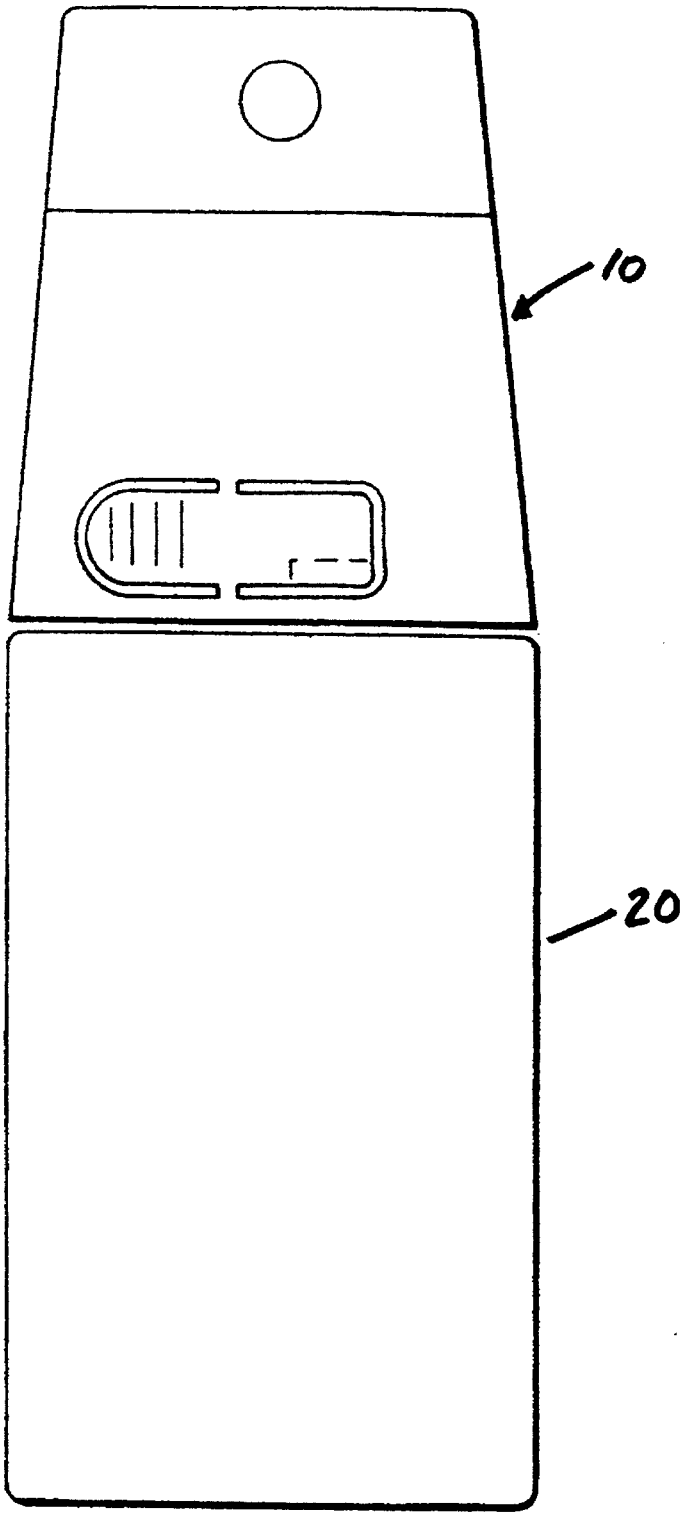
FIG. 10 is another alternate of the design of FIG. 1.

The design of FIGS. 5–6 is similar to that of FIGS. 1–4, but it does not have a thread. After pushing both buttons, the cap simply lifts off. The cap is free to rotate in the closed position. This design of FIGS. 7–9 is similar to that of FIGS. 5–6, only the cap is oriented on a square or rectangular package. The cap is aligned on the package and is not free to rotate. The design of FIG. 10 is similar to the above concepts except the button is horizontal. This design can be molded in two pieces (cap and bottle) as opposed to the three-piece design that would be required for the other designs.

Figure 11:
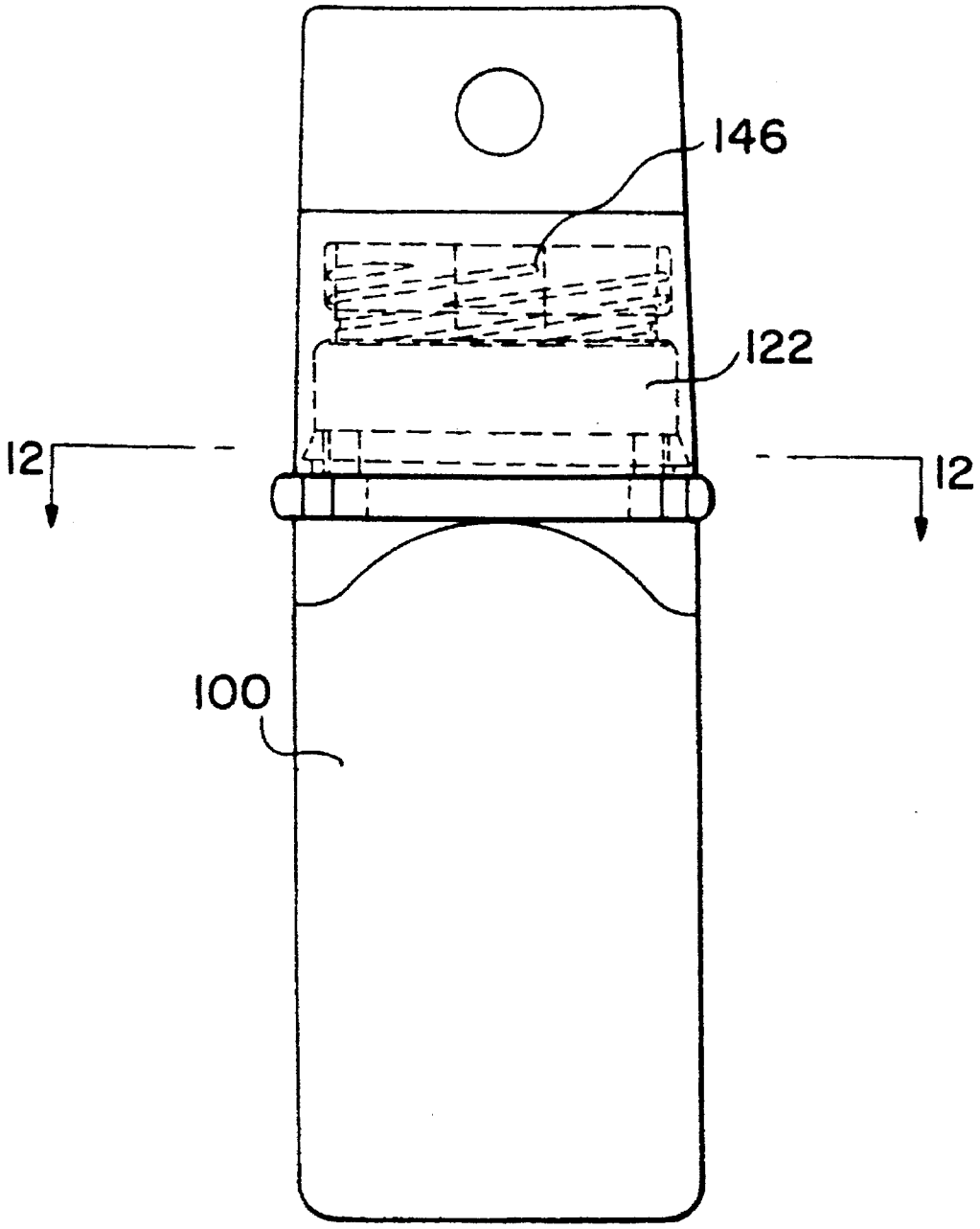
FIG. 11 is a cross sectional view of the engagement between the cap and the bottle in a second embodiment.
Figure 12:
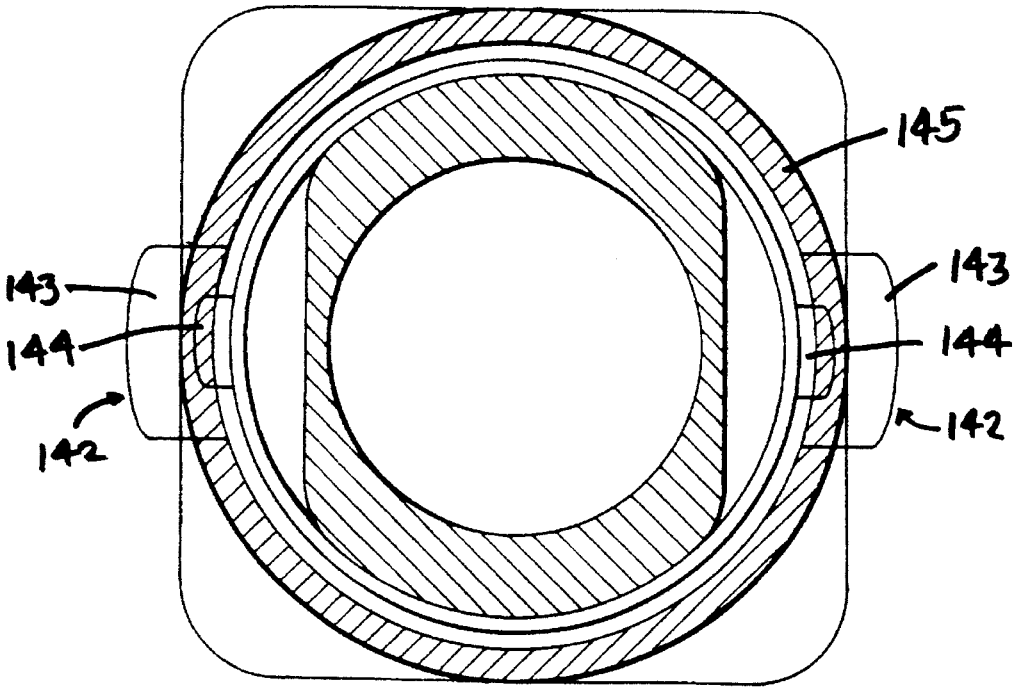
FIG. 12 is a view of the engagement between the bottle and the cap of FIG. 11 in the unlocked position.
Figure 13:
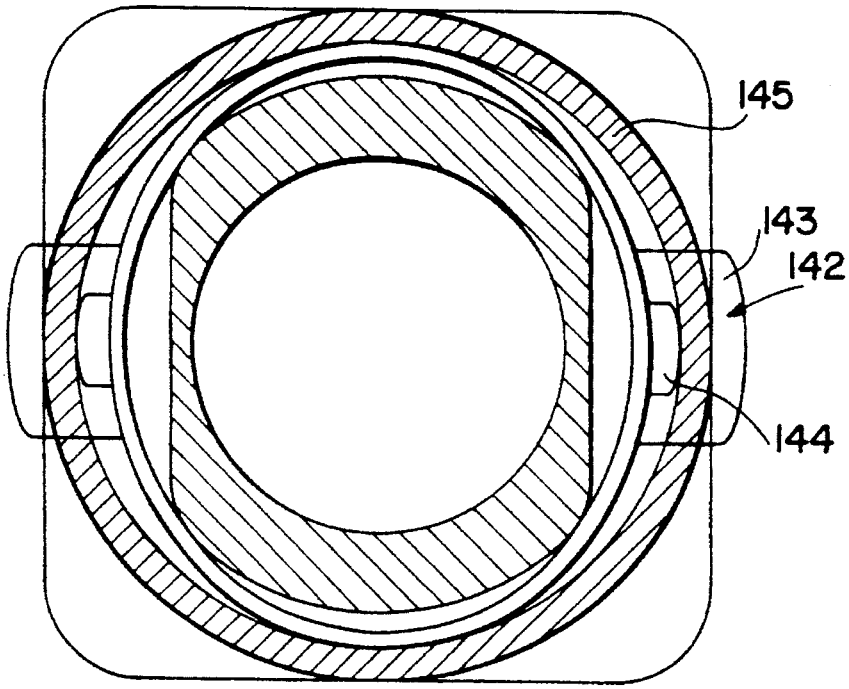
FIG. 13 is a view of the engagement between the alignment means and the irregularity on the cap of FIG. 11 in the locked position.

As can be appreciated from FIGS. 11 through 13, there is contained another preferred embodiment of the invention. In this embodiment, the push button 142 mechanism is contained on the neck of the bottle, but rather than a nub-like deformity contained on the cap is a levered flange 143 which may be compressed toward the inside of the bottle 100 by a deformable ring 145. Again, the cap contains an irregularity 144 which maintains the cap on the neck of the bottle as described in FIGS. 1 through 4. Similarly, the neck 122 contains an alignment means formed by a notch 146, as in FIGS. 1 through 4. Operation of the embodiment of FIGS. 5 through 8 is quite similar to operation of the embodiment described by FIGS. 1 through 4.

Figure 14:
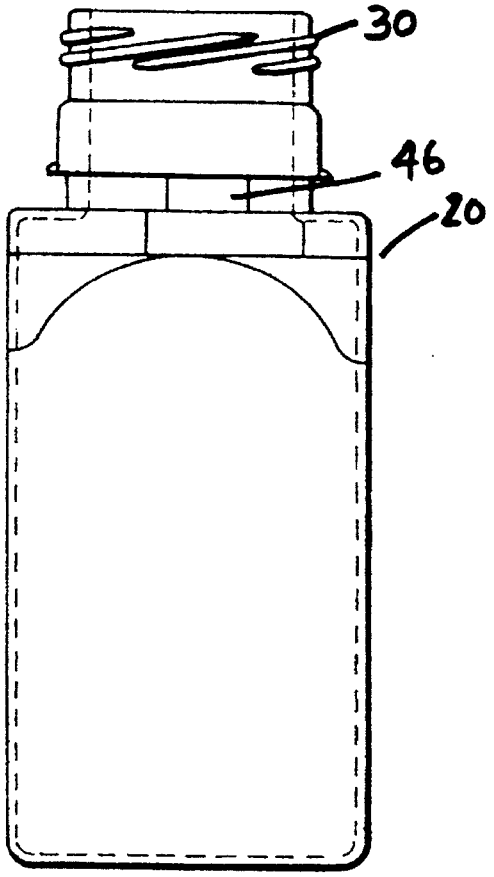
FIG. 14 is a cross sectional view of a embodiment of this invention.
Figure 15:
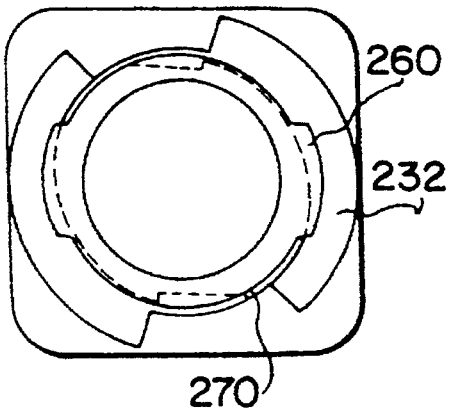
FIG. 15 is a top cross sectional view of the engagement between the cap and the bottle of FIG. 14.
Figure 16:
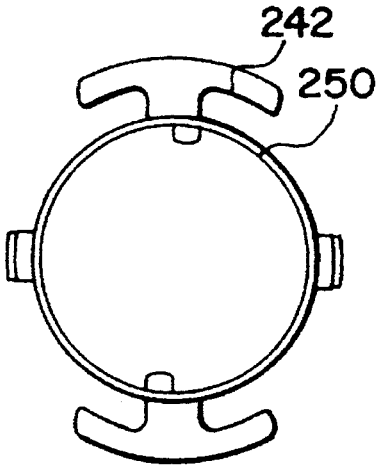
FIG. 16 is an enlarged view of the engagement between the bottle and the cap of FIG. 15.

As can be seen from FIGS. 14 through 16, there is contained a third preferred embodiment of this invention. In this embodiment, there is contained an independently rotated ring 250 which is associated with the cap 232 of the invention. The ring 250 contains on it a rotating button 242 similar to the push buttons described in FIGS. 1 through 8. However, the alignment mechanism is now a cam and latch, rather than the ball, groove or notch represented by the previous Figures. Regardless, alignment will still occur when the push button 242 on the ring 250 is rotated.

In this embodiment, however, once there is alignment, there also must be engagement between the cap 232 and the ring 250. This is accomplished by means of the flange 260 located underneath the cap 232 and attached to the ring 250. That is, when the ring is properly positioned on the neck, the ring may be moved away from the bottle. In this process, the flange 260 contained on the ring 250 engages the flange 270 contained on the cap 232 so that the cap 232 is also able to be unthreaded away from the bottle. Thereafter, the threads on the cap engage the threads on the bottle similar to some of the prior embodiments described above. In use therefore, the function of the embodiment of FIGS. 14 through 16 is quite similar to the function of the embodiments of FIGS. 1 through 13. Of course, allowing the top to be "flipped" off is also possible.

A particularly preferred set of embodiments has been described herewith. It will be appreciated by those skilled in the art that these are not the only means by which caps of the present invention may be designed. It is intended that the invention described herein be understood by the attached claims and their equivalents.

What is claimed is:

1. A child resistant container, comprising:

(1) a bottle having a neck, said bottle also having a containment area to store tablets accessible through an opening in said neck;

(2) a cap having a skirt, said skirt engageable with said neck; and (3) access means for allowing attachment of said neck to said skirt, said access means comprising:

(i) a push button associated with said cap;

(ii) an irregularity comprising a ball contained on the inside of said skirt; and (iii) alignment means on said neck, said alignment means engageable with the irregularity on said cap;

wherein when said push button is pushed by the user, said irregularity engages said alignment means such that said cap may be translated parallel to the longitudinal axis of said bottle, so that thereafter said cap may be removed from said bottle.

2. The bottle of claim 1 wherein said push button is contained on said cap.

3. The bottle of claim 1 wherein said push button is contained on a ring held between said cap and said bottle.

4. The bottle of claim 3 where ring and said cap are rotatable around said longitudinal axis independently of one another until said irregularity is placed in said alignment means.

5. The bottle of claim 1 wherein said alignment means is a groove found in said neck.

6. The bottle of claim 1 wherein said cap rotates freely about said longitudinal axis without engaging said neck threads until said irregularity is placed in said alignment means.

7. The bottle of claim 1 wherein said cap is readily deformable so that said irregularity may fit into said alignment means.

8. The bottle of claim 1 wherein said translation corresponds to a pulling of said cap away from said alignment means.

9. A child resistant container, comprising:

(1) a bottle having a threaded neck, said bottle also having a containment area to store tablets accessible through an opening in said neck;

(2) a cap having a threaded skirt, the threads on said skirt engageable with the threads on said neck; and (3) access means for allowing attachment of the threads on said neck with the threads on said skirt, said access means comprising:

(i) a push button associated with said cap;

(ii) an irregularity comprising a ball contained on the inside of said cap; and (iii) alignment means on said neck, said alignment means engageable with the irregularity on said cap;

wherein when said push button is pushed by the user, said irregularity engages said alignment means such that said cap may be translated parallel to the longitudinal axis of said bottle, whereby said respective threads engage one another, so that thereafter said cap may be unscrewed from said bottle; and wherein said cap rotates freely about said longitudinal axis without engaging said neck threads until said irregularity engages said alignment means.

10. A child resistant container, comprising:

(1) a bottle having a threaded neck, said bottle also having a containment area to store tablets accessible through an opening in said neck;

(2) a cap having a threaded skirt, the threads on said skirt engageable with the threads on said neck; and (3) access means for allowing attachment of the threads on said neck with the threads on said skirt, said access means comprising:

(i) a push button associated with said cap;

(ii) an irregularity comprising a ball contained on the inside of said cap; and (iii) alignment means on said neck, said alignment means engageable with the irregularity on said cap;

wherein when said push button is pushed by the user, said irregularity engages said alignment means such that said cap may be translated parallel means such that said cap may be translated parallel to the longitudinal axis of said bottle, whereby said respective threads engage one another, so that thereafter said cap may be unscrewed from said bottle; and wherein said translation corresponds to a pulling of said cap away from said containment means.

* * * * *